US009381535B2

(12) United States Patent
McDonnell

(10) Patent No.: US 9,381,535 B2
(45) Date of Patent: Jul. 5, 2016

(54) PORTABLE HUMIDIFIER

(71) Applicant: For Life Products, Inc., Miramar, FL (US)

(72) Inventor: Joseph A. McDonnell, Weston, FL (US)

(73) Assignee: For Life Products, LLC, Miramar, FL (US)

( * ) Notice: Subject to any disclaimer, the term of this patent is extended or adjusted under 35 U.S.C. 154(b) by 582 days.

(21) Appl. No.: 13/660,565

(22) Filed: Oct. 25, 2012

(65) Prior Publication Data

US 2013/0099025 A1 Apr. 25, 2013

Related U.S. Application Data

(60) Provisional application No. 61/551,189, filed on Oct. 25, 2011.

(51) Int. Cl.

| | |
|---|---|
| ***B05B 15/06*** | (2006.01) |
| ***B05B 17/06*** | (2006.01) |
| ***F24F 6/14*** | (2006.01) |
| ***F24F 6/00*** | (2006.01) |
| *B05B 9/03* | (2006.01) |

(52) U.S. Cl.

CPC ..... *B05B 15/065* (2013.01); *B05B 17/0607* (2013.01); *B05B 17/0615* (2013.01); *B05B 17/0676* (2013.01); *F24F 6/00* (2013.01); *B05B 9/03* (2013.01); *F24F 6/14* (2013.01); *F24F 2006/008* (2013.01)

(58) Field of Classification Search

CPC .. B05B 7/0248; B05B 11/0054; B05B 15/06; B05B 17/0615; B05B 17/0646; B05B 17/0676; B05B 15/065; F24F 6/12; F24F 6/14

See application file for complete search history.

(56) References Cited

U.S. PATENT DOCUMENTS

| | | | | |
|---|---|---|---|---|
| 4,921,639 | A * | 5/1990 | Chiu | 261/67 |
| 6,135,427 | A * | 10/2000 | Tsai | 261/26 |
| 6,749,181 | B1 * | 6/2004 | Chen | 261/66 |
| 7,607,592 | B1 * | 10/2009 | Kim | 239/377 |
| 8,291,947 | B2 * | 10/2012 | Michels | 141/319 |

* cited by examiner

*Primary Examiner* — Ryan Reis

(74) *Attorney, Agent, or Firm* — Bass, Berry & Sims PLC

(57) ABSTRACT

A portable humidifier that comprises a base unit that produces mist and a connecting member (bottle adaptor) that detachably connects one or more types of reservoirs (disposable water bottles) to the base unit. The connecting member (bottle adaptor) includes a first connecting portion that detachably connects the one or more types of reservoirs (disposable water bottles) to the connecting member, a second connecting portion that detachably connects the connecting member to the base unit.

20 Claims, 6 Drawing Sheets

PORTABLE HUMIDIFIER

This application claims priority under 35 U.S.C. § 119(e) to U.S. Provisional Patent Application No. 61/551,189, entitled "Fluid Container Adapter," filed Oct. 25, 2011, the entire contents of which are incorporated herein by reference.

BACKGROUND OF THE INVENTION

1. Field of the Invention

The present invention relates to a portable humidifier that is configured to utilize a disposable water bottle as a reservoir. The present invention also relates to a bottle adaptor that detachably connects a water bottle to the portable humidifier.

2. Description of the Related Art

A humidifier primarily provides humidity to an environment. In order to provide humidity, a humidifier needs water to produce mist. If a humidifier is not connected to a water supply, a humidifier generally includes a reservoir that holds water that is waiting to be used to produce mist.

The reservoir of a humidifier is typically large in size and can be unwieldy in shape, which does not allow of ease of portability, cleaning, or filling of the reservoir. Further, problems may occur when water is left in a reservoir for a period of time because the water may become contaminated with algae or bacteria, which can cause health problems if the reservoir is not cleaned before use.

SUMMARY OF THE INVENTION

In one embodiment of the present invention, a portable humidifier comprises a base unit that produces mist and a connecting member that detachably connects one or more types of reservoirs to the base unit. The connecting member includes a first connecting portion that detachably connects the one or more types of reservoirs to the connecting member, a second connecting portion that detachably connects the connecting member to the base unit.

In another embodiment of the present invention, a bottle adaptor detachably connects a disposable water bottle to a humidifier. The bottle adaptor comprises a first connecting portion that detachably connects to a disposable water bottle, wherein the first connecting portion includes a plurality of bottle type connectors that detachably connect to disposable water bottles with a plurality of bottle opening diameters of different sizes. The bottle adaptor further comprising a second connecting portion that detachably connects to the humidifier.

There has thus been outlined, rather broadly, certain embodiments of the invention in order that the detailed description may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present invention will become more fully understood from the detailed description and the accompanying drawings, wherein.

DETAILED DESCRIPTION OF EXAMPLE EMBODIMENTS

Figure 1:
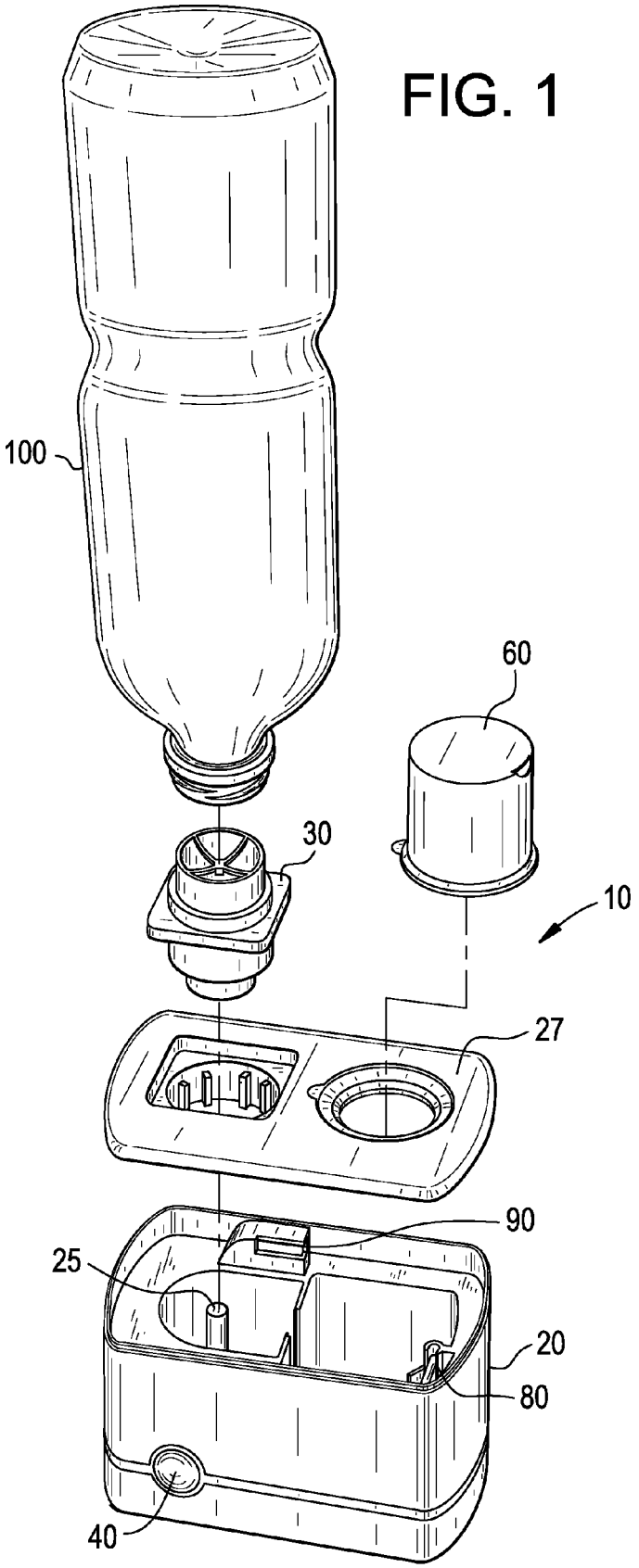
FIG. 1 is an exploded perspective view illustrating a portable humidifier in accordance with an embodiment of the invention.

Specific structural and functional details disclosed herein are merely representative for purposes of describing example embodiments of the present invention. This invention may, however, be embodied in many alternate forms and should not be construed as limited to only the embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the invention. As used herein, the term "and/or" includes any and all combinations of one or more of the associated listed items.

The terminology used herein is for the purpose of describing particular embodiments only and is not intended to be limiting of example embodiments of the invention. As used herein, the singular forms "a," "an," and "the" are intended to include the plural forms as well, unless the context clearly indicates otherwise. It will be further understood that the terms "comprises," "comprising," "includes," and/or "including," if used herein, specify the presence of stated features, integers, steps, operations, elements, and/or components, but do not preclude the presence or addition of one or more other features, integers, steps, operations, elements, components, and/or groups thereof.

The invention will now be described with reference to the drawing figures, in which like reference numerals refer to like parts throughout.

An embodiment in accordance with the present invention provides a portable humidifier that can easily be transported to various locations, such as a residence, an office, or a travel location. A detachable connecting member allows a reservoir, such as a disposable water bottle, to be connected to the humidifier to be used to produce mist. The portable humidifier is easily transported as an empty reservoir is not required to be transported with the device. A reservoir, such as a disposable water bottle, can be easily obtained at any location. Further, the portable humidifier is compact in size and allows for easy transport and storage.

FIG. 1 shows a view of a portable humidifier 10 in accordance with one exemplary embodiment of the present invention. The portable humidifier 10 includes a base unit 20 and a connecting member (bottle adaptor) 30.

In an exemplary embodiment, the base unit 20 includes an engaging member 25 that engages with the connecting member 30, a control unit 50 that controls the production of mist by a mist producing unit 55, and an input unit (button) 40 that receives operation instructions for controlling the control unit 50. In one embodiment, the input unit 40 is disposed in the base unit 20. However, the input unit 20 may a separate unit, such as a wired or wireless remote control.

Figure 3:
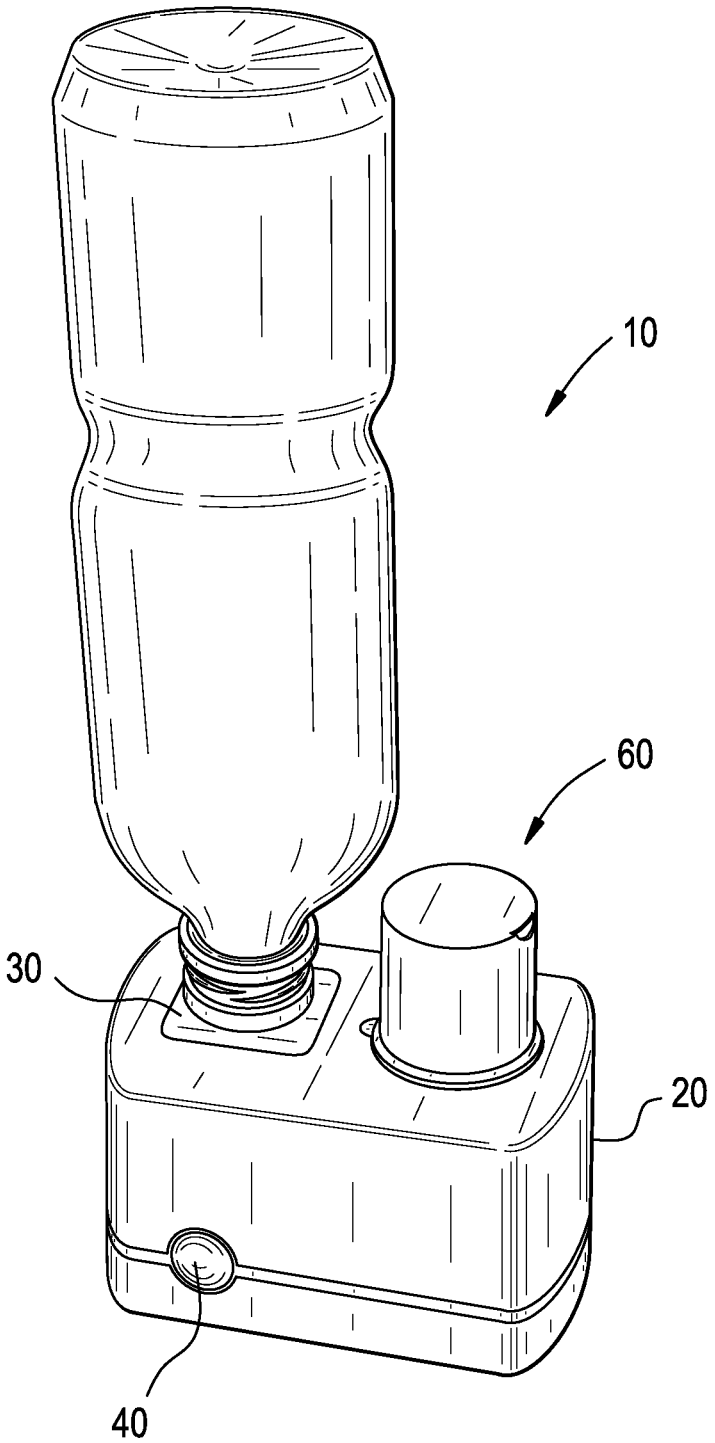
FIG. 3 is a perspective view illustrating a portable humidifier in accordance with an embodiment of the invention.

As shown in FIG. 1, the connecting member 30, serving as a bottle adaptor, is used to connect a reservoir 100 to the base unit 20. The connecting member 30 allows the use of a disposable water bottle to act as a reservoir 100. The reservoir 100 holds water used by the mist producing unit 55 in the base unit 20 to produce mist. A disposable water bottle, serving as the reservoir 100, may be connected to the connecting member 30 by inserting the first connecting portion 31 fully into the reservoir 100. Alternatively, reservoir 100 may be connected to the connecting member 30 by being screwed into the first connecting portion 31. The connecting member 30 may be connected to the base unit 20 by inserting the second connecting portion 32 fully into the base unit 20, as shown in FIG. 3.

Figure 2:
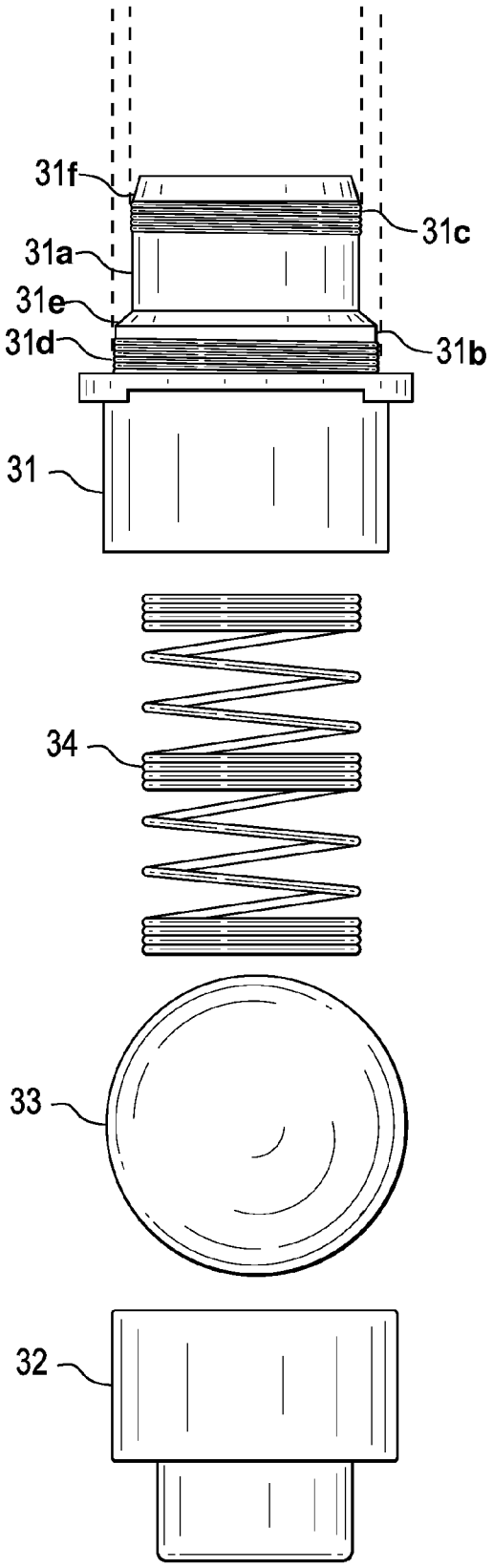
FIG. 2 is an exploded view illustrating a connecting member (bottle adaptor) of a portable humidifier in accordance with an embodiment of the invention.

As shown in FIG. 2, the connecting member 30 includes a first connecting portion 31 that detachably connects the reservoir 100 to the connecting member 30, and a second connecting portion 32 that detachably connects the connecting member 30 to the base unit 20. As shown by the dashed lines, the first connecting portion 31 is able to accommodate disposable water bottles with bottle openings having different inner diameters. The connecting portion 31 has an outer surface for engaging the inner diameter of a bottle opening capable of securely engaging a range of inner diameter bottle openings that, when properly positioned, forms a secure seal reducing potential leakage from the bottle when in use. FIG. 2 shows a first bottle type connector 31*a* of connecting portion 31 and a second bottle type connector 31*b* of connecting portion 31. In one exemplary embodiment, the first bottle type connector 31*a* detachably connects to a disposable bottle type with a top outer diameter of one size. The second bottle type connector 31*b* detachably connects to a disposable bottle type with a top outer diameter of a different size and comparatively larger than the outer diameter of the first bottle type connector 31*a*. The connection portion 31 also has one or more flanged transition areas 31*e*, 31*f*, that promote engagement of a leading end of the connection portion 31 with a bottle opening. While two bottle type connectors and flanged transition areas are shown in FIG. 2, more than two connectors/transition areas may be used as the outer diameter of each connector increases. As also shown in FIG. 2, connecting portion 31 may also include a first bottle type connector sealing member 31*c* that prevents water leaking from a disposable water bottle that is connected to first bottle type connector 31*a*, and a second bottle type connector sealing member 31*d* that prevents water leaking from a disposable water bottle that is connected to second bottle type connector 31*b*. In the exemplary embodiment, the bottle type sealing members have threaded portions that assist in advancing the connecting portion 31 into a bottle by engaging the inner walls of the bottle opening and for creating a seal between the bottle and sealing member. In other embodiments, other area configurations, such as serrations, abrasives and channels, that secures the inner diameter of the bottle opening to the connection portion thus promoting advancement of the connecting portion inside the bottle, stabilizing the connection seal and/or resisting retreat of the connection portion 31 from the bottle opening. Moreover, while exemplary embodiment has stepped portions from one outer diameter connector to another, the connection portion 31 may have combinations of connection portions with the same or different outer diameters, transition areas, and sealing members.

As shown in FIG. 2, the connecting member 30 may also include a movable sealing member 33 that controls the flow of water from a reservoir 100, and an urging member 34 that moves the movable sealing member 33. The sealing member 33 may be a ball bearing, as shown in FIG. 2. However, the movable sealing member 33 may also be a stopper, membrane, or other known device that is capable of controlling the flow of a liquid. The movable sealing member 33 is kept in a closed position by the urging member 34 when the connecting member 30 is not connected to the base unit 20. The movable sealing member 33 is moved to an open position when the connecting member 30 is connected to the base unit 20, as shown in FIG. 3.

In one embodiment of the present invention, the movable sealing member 33 of the connecting member 30 contacts the engaging member 25 of the base unit 20 when the connecting member 30 is connected to the base unit 20. When connecting the connecting member 30 to the base unit 20, the engaging member 25 moves the movable sealing member 33 into the open position. When the disconnecting the connecting member 30 from the base unit 20, the urging member 34 moves the movable sealing member 33 into the closed position. The moveable sealing member 33 is kept in the closed position by the urging member 34 when the connecting member 30 is not connected to the base unit 20. The urging member 34 may be a spring or another know device that keeps the connecting member 30 in the closed position when the connecting member 30 is not connected to the base unit 20.

The base unit 20 is connected to a power source (not shown) to provide power to the electronic components of the control unit 50 of the portable humidifier 10. The input unit 40 is connected to the control unit 50 and instructs the control unit 50 to control the production of mist by the mist producing unit 55. According to one embodiment, the mist producing unit 55 of the base unit 20 produces mist by ultrasonic nebulization, but any other known mist producing method may also be used.

Figure 6:
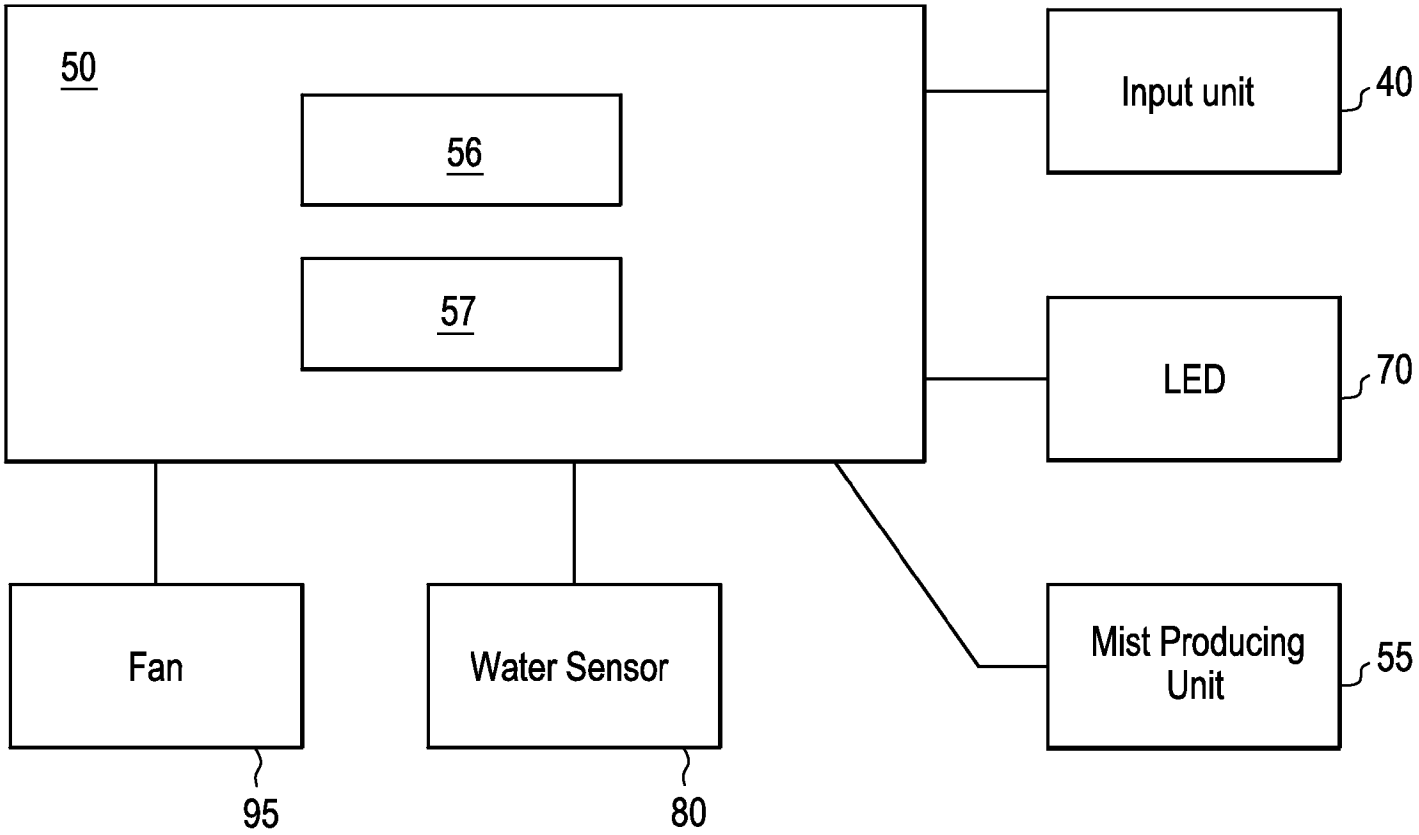
FIG. 6 is a schematic of connections to a control unit of the portable humidifier in accordance with an embodiment of the invention.

As shown in FIG. 6, the control unit 50 may include a processor 56 and a memory 57. The processor 56 and memory 57 are electronically connected to the input unit 40, the mist producing unit 55, an LED 70, a water sensor 80, and a fan 95. The processor 56 and memory 57 control the operation of the portable humidifier 10 and execute the various functions of the portable humidifier 10, as discussed below.

In the one embodiment of the present invention, the input unit 40 is a button. Alternatively, the input unit 40 may be a switch or other device capable receiving operation instructions for controlling the control unit 50. The input unit (button) 40 may be used to turn on and turn off the portable humidifier 10 when pressed. In an exemplary embodiment, the portable humidifier 10 is turned on when the input unit (button) 40 is pressed once, and the portable humidifier 10 is turned off when the input unit (button) 40 is pressed once again.

In another embodiment of the present invention, the input unit (button) 40 may be used to turn on and turn off the portable humidifier 10 and to change the mist output level when pressed. The portable humidifier 10 is turned on when the input unit (button) 40 is pressed once. To turn off the portable humidifier 10, the input unit (button) 40 is pressed twice. When the portable humidifier 10 is turned on, to change the mist output level, the input unit (button) 40 is pressed once. The mist output level will cycle through a plurality of mist output levels for each pressing of the input unit (button) 40. In one embodiment of the present invention, the highest mist output setting is selected by default when the portable humidifier 10 is turned on. Alternatively, the lowest mist output setting is selected by default when the portable humidifier 10 is turned on. In yet another embodiment, the input unit (button) 40 may be pressed once to turn on the portable humidifier 10 to a default mist output level, pressed a second time to change the mist default output level to a different mist output level, and pressed a third time to turn off the portable humidifier 10.

In another embodiment of the present invention, the base unit 20 may also include a light, such as light emitting diode (LED) 70. The LED 70 may illuminate when the portable humidifier 10 is connected to a power source, or, alternatively, the LED 70 may illuminate when the portable humidifier is turned on by the input unit 40. The LED 70 may be disposed in input unit 40, or alternatively, may be disposed in the base unit 20 of the portable humidifier 10

In one embodiment of the present invention, the base unit 20 may include a water sensor 80 that determines whether water is present. The water sensor 80 is connected to the control unit 50. When the water sensor 80 determines that there is no water present, the control unit 50 automatically turns off the mist producing unit 55 of the portable humidifier 10. In another embodiment, the control unit 50 may automatically turn off LED 70 when the water sensor 80 determines that there is no water present.

As shown in FIGS. 1 and 3, the base unit 20 may include a nozzle 60 that directs the flow of mist from the portable humidifier 10. The nozzle 60 detachably connects to the base unit 20, as shown in FIG. 3. The nozzle 60 may be connected to the base unit 20 in an inverted position when the portable humidifier 10 is not in use.

Figure 5:
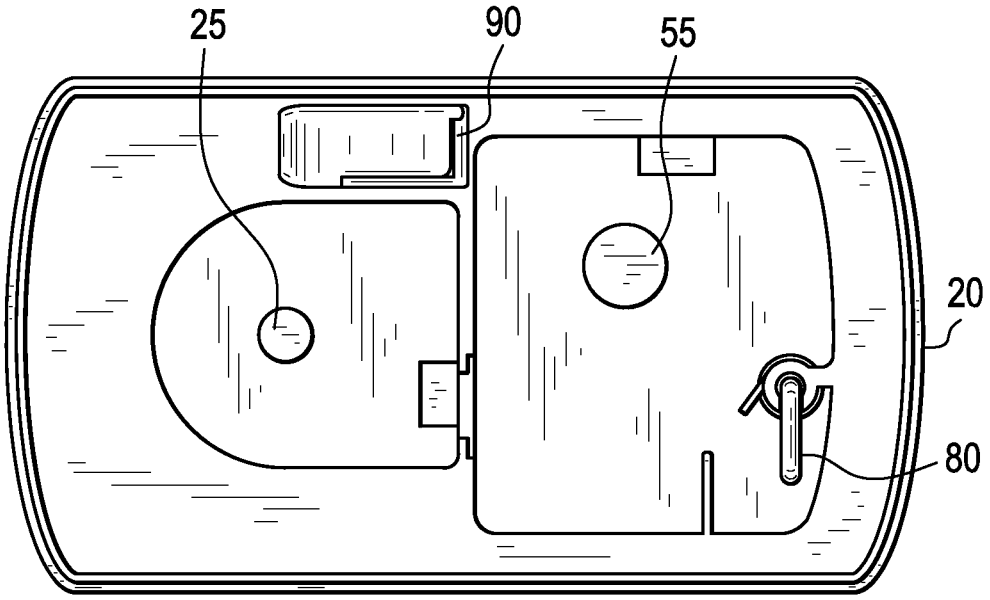
FIG. 5 is a top view illustrating a base unit of the portable humidifier in accordance with an embodiment of the invention.

As shown in FIG. 5, the base unit 20 may include an air outlet 90 that assists in the flow of mist from the base portion 20. The base unit 20 may also include a fan 95 (FIG. 6) that assists in the control of the flow of mist from the base portion 20 and through the nozzle 60. The fan 95 directs air flow through the base unit 20 and out of the air outlet 90. The fan 95 may also assist in the flow of mist produced by the mist producing unit 55 to be directed out of the nozzle 60. The fan 95 is connected to the control unit 50. In one embodiment, the speed of fan 95 may change in response to the mist output level received by the input unit 40. For example, the fan 95 increases in speed when a high mist output level is received by the input unit 40.

Figure 4:
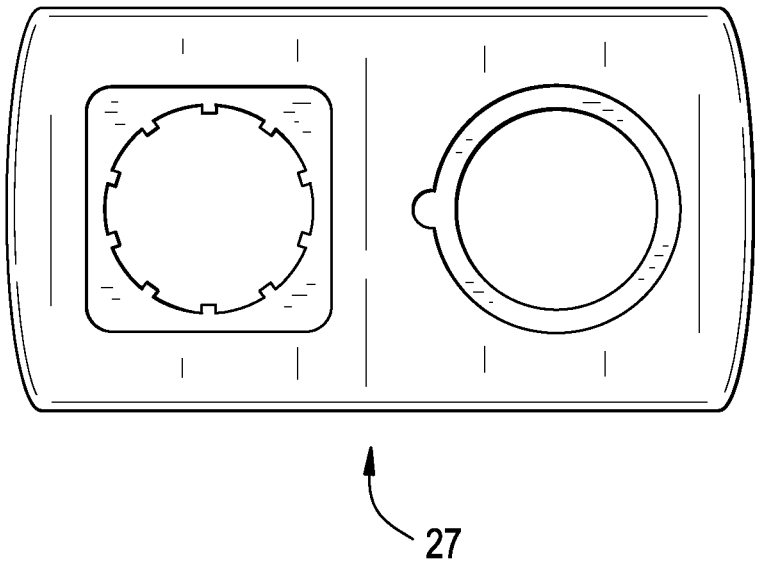
FIG. 4 is a top view illustrating a top cover of a base unit of the portable humidifier in accordance with an embodiment of the invention.

In another embodiment, the base unit 20 may include a top cover 27 that is removable. When the top cover 27 is removed from base unit 20, water can easily be removed from the base unit 20, and allows for easier cleaning of the portable humidifier 10. As shown in FIGS. 3 and 4, the connecting member 30 and the nozzle 60 may connect to the top cover 27 of said base unit.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A portable humidifier comprising:
- a base unit;
- a mist producing unit; and,
- a reservoir connecting member having a first end and a second end, wherein:
  - said first end includes a first annular portion having an interior surface defining a first aperture,
  - said second end includes a second annular portion, said second annular portion having an interior surface defining a second aperture and an exterior surface having different orientations along said exterior surface for defining a plurality of connectors for detachably engaging interior surfaces of corresponding reservoir openings and forming a seal with said interior surfaces of said reservoir openings,
  - at least a portion of said first and second apertures together form an opening through said reservoir connecting member from said first end to said second end, and
  - said first end is detachably connected to a receiving portion of said base unit.

2. The portable humidifier according to claim 1, wherein said opening through said reservoir connecting member includes a sealing member in contact with at least a portion of said opening.

3. The portable humidifier according to claim 1, wherein:
- said second annular portion exterior surface has a first diameter defining a first connector and a second diameter defining a second connector, and the second diameter is different than said first diameter.

4. The portable humidifier according to claim 2, wherein said receiving portion of said base unit includes an engaging member, and said engaging member is in contact with said sealing member when the reservoir connecting member is connected to the receiving portion of the base unit.

5. The portable humidifier according to claim 1, further comprising an electronic control unit electronically connected to said mist producing unit.

6. The portable humidifier according to claim 5, further comprising a water detector electronically connected to said electronic control unit.

7. The portable humidifier according to claim 1, further comprising a nozzle having a proximal end and a distal end, wherein:
- said proximal end is detachably connected to said base unit,
- said distal end includes at least one outlet through which mist travels, and
- said nozzle extends away from said base unit in a direction from said proximal end to said distal end.

8. The portable humidifier according to claim 5, further comprising an LED electronically connected to said electronic control unit.

9. The portable humidifier according to claim 1, wherein said base unit includes a top cover.

10. The portable humidifier according to claim 9, wherein said first end of said reservoir connecting member is detachably connected to said top cover of said base unit.

11. The portable humidifier according to claim 1, wherein said mist producing unit is an ultrasonic nebulizer.

12. The portable humidifier according to claim 5, further comprising a fan electronically connected to said electronic control unit.

13. The portable humidifier according to claim 9, further comprising a nozzle having a proximal end and a distal end, wherein said proximal end is detachably connected to said top cover of said base unit and said nozzle extends towards said base unit in a direction from said proximal end to said distal end.

14. A portable humidifier reservoir connecting member comprising:

a first end and a second end, wherein:

said first end includes a first annular portion having an interior surface defining a first aperture, said second end includes a second annular portion, said second annular portion having an interior surface defining a second aperture and an exterior surface having different orientations along said exterior surface for defining a plurality of connectors for detachably engaging interior surfaces of corresponding reservoir openings and forming a seal with said interior surfaces of said reservoir openings, at least a portion of said first and second apertures together form an opening through said portable humidifier reservoir connecting member from said first end to said second end, and said first end is detachably connected to a portable humidifier.

15. The portable humidifier reservoir connecting member according to claim 14, wherein:

said second annular portion exterior surface has a first diameter defining a first connector and a second diameter defining a second connector, and said second diameter is different than said first diameter.

16. A portable humidifier comprising:

a base unit;

a mist producing unit;

a nozzle having a proximal end connected to said base unit and a distal end including an outlet through which mist travels; and, a reservoir connecting member having a first end and a second end, wherein:

said first end includes a first annular portion having an interior surface defining a first aperture, said second end includes a second annular portion, said second annular portion having an interior surface defining a second aperture and an exterior surface having different orientations along said exterior surface for defining a plurality of connectors for detachably engaging interior surfaces of corresponding reservoir openings and forming a seal with said interior surfaces of said reservoir openings of, at least a portion of said first and second apertures together form an opening through said reservoir connecting member from said first end to said second end, and said first end is connected to a receiving portion of said base unit.

17. The portable humidifier according to claim 16, wherein:

said second annular portion exterior surface has a first diameter defining a first connector and a second diameter defining a second connector, and the second diameter is different than said first diameter.

18. The portable humidifier according to claim 16, wherein said first end is detachably connected to said receiving portion of said base unit.

19. The portable humidifier according to claim 16, wherein said proximal end of said nozzle is detachably connected to a cover of said base unit.

20. The portable humidifier according to claim 1, wherein said exterior surface of said second annular portion has a threaded portion.

* * * * *